US007228861B2

(12) United States Patent
Atobe et al.

(10) Patent No.: US 7,228,861 B2
(45) Date of Patent: Jun. 12, 2007

(54) CIGARETTE FILTER

(75) Inventors: Ichiro Atobe, Tokyo (JP); Fumihiro Omori, Tokyo (JP)

(73) Assignee: Japan Tobacco, Inc., Tokyo (JP)

( * ) Notice: Subject to any disclaimer, the term of this patent is extended or adjusted under 35 U.S.C. 154(b) by 460 days.

(21) Appl. No.: 10/767,056

(22) Filed: Jan. 30, 2004

(65) Prior Publication Data

US 2004/0182400 A1 Sep. 23, 2004

Related U.S. Application Data

(63) Continuation of application No. PCT/JP02/07807, filed on Jul. 31, 2002.

(30) Foreign Application Priority Data

Aug. 2, 2001 (JP) ..... 2001-235203

(51) Int. Cl.
*A24D 3/04* (2006.01)

(52) U.S. Cl. ..... 131/342; 131/341; 131/202; 131/207; 131/344

(58) Field of Classification Search ..... 131/202, 131/207, 341, 342, 344, 331
See application file for complete search history.

(56) References Cited

U.S. PATENT DOCUMENTS 5,404,890 A 4/1995 Gentry et al.
5,662,126 A 9/1997 Charlton et al.
6,779,529 B2 * 8/2004 Figlar et al. ..... 131/334

FOREIGN PATENT DOCUMENTS

| | | |
|---|---|---|
| JP | 61-100998 U | 6/1986 |
| JP | 63-160659 A | 7/1987 |
| JP | 4-267871 A | 9/1992 |
| JP | 7-67613 A | 3/1995 |
| JP | 00/35580 | 6/2000 |
| JP | 2000-246095 A | 9/2000 |

* cited by examiner

*Primary Examiner*—Dionne W. Mayes
(74) *Attorney, Agent, or Firm*—Birch, Stewart, Kolasch & Birch, LLP

(57) ABSTRACT

A cigarette filter has filter sections including filter materials individually wrapped with plug wrap paper, forming paper for wrapping the filter sections integrally, and tipping paper covering the forming paper so as to connect the filter sections to a cigarette section to form a cigarette, wherein activated charcoal and an inorganic mineral-based porous material carrying ferrous sulfate/L-ascorbic acid are contained as adsorbents in at least one of the filter materials and a space between the filter materials.

2 Claims, 2 Drawing Sheets

CIGARETTE FILTER

CROSS-REFERENCE TO RELATED APPLICATIONS

This is a Continuation Application of PCT Application No. PCT/JP02/07807, filed Jul. 31, 2002, which was not published under PCT Article 21(2) in English.

This application is based upon and claims the benefit of priority from the prior Japanese Patent Application No. 2001-235203, filed Aug. 2, 2001, the entire contents of which are incorporated herein by reference.

BACKGROUND OF THE INVENTION

1. Field of the Invention

The present invention relates to an improved cigarette filter capable of singularly adsorbing specified components contained in mainstream smoke.

2. Description of the Related Art

Japanese Patent Disclosure (Kokai) No. 63-160659, for example, discloses a deodorizing agent (adsorbing agent) consisting of an inorganic mineral-based porous material carrying ferrous sulfate/L-ascorbic acid. The document also discloses an example of a filter for a cigarette in which the deodorizing agent is contained.

However, the adsorbent disclosed in the document is intended to adsorb mainly ammonia, and it is not described at all in the document what components of the mainstream smoke are removed in the case where the adsorbent is contained in the cigarette filter. In general, in the case of using a filter containing an adsorbent capable of unselectively adsorbing various components contained in the mainstream smoke, it is known to the art that the taste and flavor of the cigarette are adversely affected.

BRIEF SUMMARY OF THE INVENTION

An object of the present invention is to provide a cigarette filter, which permits prominently suppressing adverse effect on the taste and flavor of a cigarette and which permits selectively removing specified components contained in mainstream smoke.

A cigarette filter according to the present invention comprises: filter sections including filter materials individually wrapped with plug wrap paper; forming paper for wrapping the filter sections integrally; and tipping paper covering the forming paper so as to connect the filter sections to a cigarette section to form a cigarette, wherein activated charcoal and an inorganic mineral-based porous material carrying ferrous sulfate/L-ascorbic acid are contained as adsorbents in at least one of the filter materials and a space between the filter materials.

In the cigarette filter of the present invention, the plug wrap paper or the forming paper may contain the activated charcoal and the inorganic mineral-based porous material carrying ferrous sulfate/L-ascorbic acid as the adsorbents.

The cigarette filter according to the present invention has actual structures including, for example, (1) a structure that two filter materials are provided and a mixture of the activated charcoal and the inorganic mineral-based porous material carrying ferrous sulfate/L-ascorbic acid is loaded in the space between the two filter materials, (2) a structure that two filter materials are provided and a mixture of the activated charcoal and the inorganic mineral-based porous material carrying ferrous sulfate/L-ascorbic acid is dispersed in one of the filter materials, (3) a structure that three filter materials are provided and the activated charcoal and the inorganic mineral-based porous material carrying ferrous sulfate/L-ascorbic acid are individually loaded in the two spaces between the three filter materials, and (4) a structure that three filter materials are provided and the activated charcoal is dispersed in one filter material and the inorganic mineral-based porous material carrying ferrous sulfate/L-ascorbic acid is dispersed in another filter material.

Another cigarette filter according to the present invention comprises a cigarette holder body including filter materials arranged therein, wherein activated charcoal and an inorganic mineral-based porous material carrying ferrous sulfate/L-ascorbic acid are contained as adsorbents in at least one of the filter materials and a space between the filter materials.

Incidentally, the structure of the cigarette filter according to the present invention is not limited to those exemplified above, and various modifications are conceivable.

The cigarette filter of the present invention may also contain silica/alumina in addition to the activated charcoal and the inorganic mineral-based porous material carrying ferrous sulfate/L-ascorbic acid as the adsorbents.

DETAILED DESCRIPTION OF THE INVENTION

Figure 1:
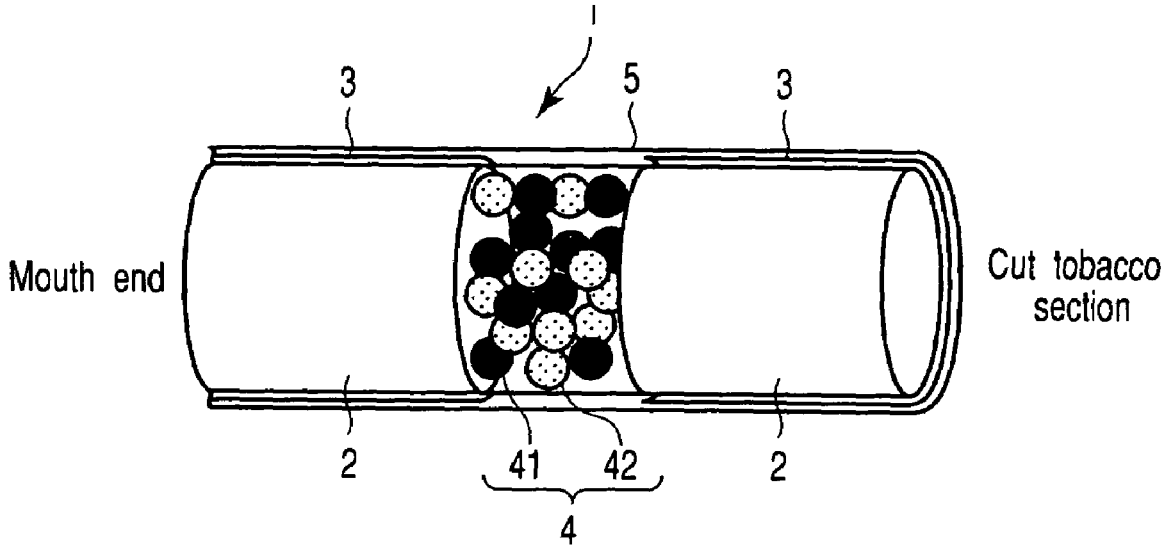
FIG. 1 schematically shows an example of a structure of a cigarette filter according to the present invention.

In the present invention, attention is paid to pyrazines and phenols as specified components contained in mainstream smoke of a cigarette.

The present inventor has found that, where activated charcoal and an inorganic mineral-based porous material carrying ferrous sulfate/L-ascorbic acid are contained as adsorbents in the cigarette filter, these adsorbents produce a synergetic effect so as to singularly remove the specified components contained in the mainstream smoke, thereby accomplishing the present invention.

The filter materials used in the present invention include, for example, acetate, paper, and an unwoven fabric. As the activated charcoal of the adsorbents, coconut shell activated charcoal may be used. As the inorganic mineral-based porous material carrying ferrous sulfate/L-ascorbic acid of the adsorbents, a product marketed under the trade name of "Anico W" by Tokai Corporation, for example, may be used. The product is formed of zeolite carrying ferrous sulfate and L-ascorbic acid and also contains bentonite and other inorganic salts. The divalent iron ions contained in the ferrous sulfate react with the specified components in the mainstream smoke of the cigarette. It should be noted that, since the divalent iron ions are unstable and are readily oxidized by oxygen so as to be changed into trivalent iron ions, the L-ascorbic acid is also added in order to suppress the oxidation of the divalent iron ions.

In the present invention, the amount of the activated charcoal and the inorganic mineral-based porous material carrying ferrous sulfate/L-ascorbic acid is set as follows: where the adsorbents are contained in the filter material, the total amount of the adsorbents should be set to 1 mg to 150 mg, preferably 20 mg to 60 mg, per 10 mm of the filter material, and where the adsorbents are contained in the space between the filter materials, the total amount of the adsorbents should be set to 5 mg to 300 mg, preferably 30 mg to 120 mg per 5 mm of the space.

It is also possible to use silica/alumina as an additional adsorbent as well as the activated charcoal and an inorganic mineral-based porous material carrying ferrous sulfate/L-ascorbic acid. As the silica/alumina, a product marketed under the trade name of "Kyoward 700SN" by Kyowa Chemical Industry Co., Ltd, for example, may be used. The product contains 63.0% by weight of $SiO_2$ and 10.3% by weight of $Al_2O_3$ and has weight loss on drying of 14.5% by weight.

Examples of the present invention will now be described.

A cigarette filter as a control without containing any adsorbent was prepared as follows. Two filter materials (plain filters) were prepared by forming acetate having a filament fineness of 2.2 denier and a tow fineness of 40,000 denier to have a length of 10 mm, and the filter materials were wrapped with plug wrap paper, respectively, so as to obtain two filter sections. Two filter materials were arranged to have a 5-mm space formed therebetween, and the two filter sections were wrapped with forming paper without loading any adsorbent in the space. The ventilation resistance of the filter was found to be 80 $mmH_2O$ (1050 mL/min).

FIG. 1 shows an example of a cigarette filter prepared in this Example. The cigarette filter 1 was prepared as follows. Two filter materials (plain filters) 2 were prepared by forming acetate having a filament fineness of 2.2 denier and a tow fineness of 40,000 denier to have a length of 10 mm, and the filter materials were wrapped with plug wrap paper, respectively, so as to obtain two filter sections. Two filter materials 2 were arranged to have a space formed therebetween, and the two filter sections were wrapped with forming paper under the state that a mixture of 30 mg of activated charcoal 41 and 30 mg of an inorganic mineral-based porous material carrying ferrous sulfate/L-ascorbic acid (trade name: Anico W) 42 as adsorbents 4 was loaded in the space. In this case, the space was controlled to permit the adsorbents to have an apparent density of 100%.

Likewise, another cigarette filter was prepared as follows. Two filter materials 2 were arranged to have a space formed therebetween, and the two filter sections were wrapped with forming paper under the state that a mixture of 30 mg of activated charcoal, 15 mg of an inorganic mineral-based porous material carrying ferrous sulfate/L-ascorbic acid (trade name: Anico W) and 15 mg of silica/alumina (trade name: Kyoward 700SN) as adsorbents 4 was loaded in the space.

Figure 2:
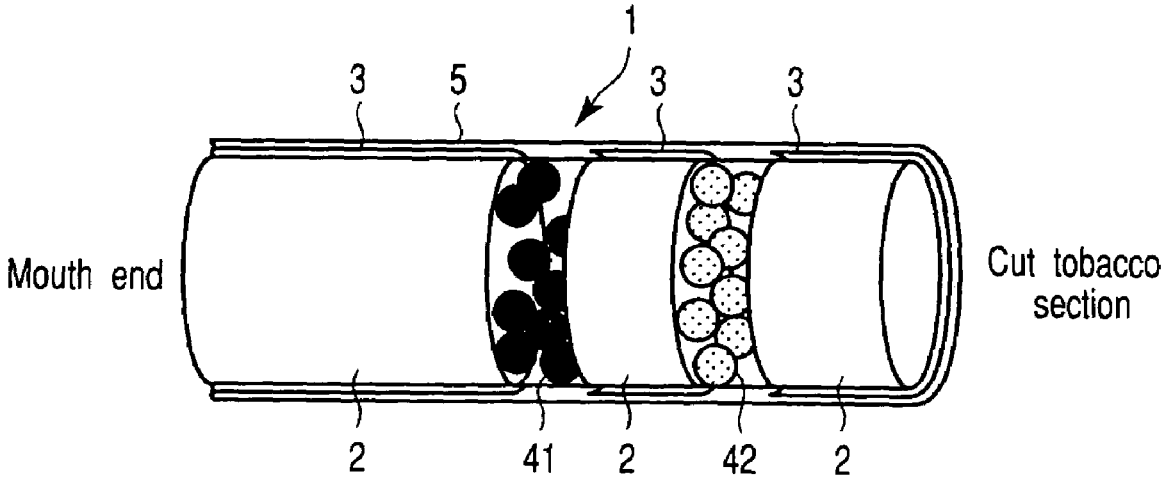
FIG. 2 schematically shows another example of a structure of a cigarette filter according to the present invention.

FIG. 2 shows another example of a cigarette filter according to the present invention. The cigarette filter 1 was prepared as follows: preparing three filter materials (plain filters) 2; forming three filter sections by wrapping plug wrap paper 3 around each of the filter materials 2; loading individually activated charcoal 41 and an inorganic mineral-based porous material carrying ferrous sulfate/L-ascorbic acid (trade name: Anico W) 42 as adsorbents 4 in the space on the cut tobacco side and in the space on the mouth side between the three filter sections; and wrapping forming paper 5 around the three filter sections. FIG. 2 shows an example in which the activated charcoal 41 was loaded in the space on the mouth side and the inorganic mineral-based porous material carrying ferrous sulfate/L-ascorbic acid was loaded in the space on the cut tobacco side. However, a cigarette filter having the contrary structure to the above was also prepared, in which the inorganic mineral-based porous material carrying ferrous sulfate/L-ascorbic acid was loaded in the space on the mouth side and the activated charcoal 41 was loaded in the space on the cut tobacco side.

For references, cigarette filters were also prepared with loading, in the space, 30 mg of activated charcoal alone, or 30 mg of an inorganic mineral-based porous material carrying ferrous sulfate/L-ascorbic acid (trade name: Anico W) alone, or 30 mg of silica/alumina (trade name: Kyoward 700SN) alone as an adsorbent.

Also, cigarette filters were prepared with loading, in the space, 60 mg of activated charcoal alone, or 60 mg of an inorganic mineral-based porous material carrying ferrous sulfate/L-ascorbic acid (trade name: Anico W) alone, or 60 mg of silica/alumina alone, i.e., an adsorbent two times as much as that in the cigarette filters noted above.

Each of the above cigarette filters was connected with a tape to a cigarette section prepared by wrapping cut tobacco with wrapper paper so as to prepare various cigarettes for experiments differing from each other in the type of the adsorbent as shown in Table 1. A commercial cigarette rod was used for the cigarette section. A test for collecting the mainstream smoke was applied to these cigarettes as follows.

The cigarette was connected to an automatic smoking machine with a tube (made of Tygon). A Cambridge filter was not provided. The automatic smoking machine was allowed to smoke the cigarette under the standard smoking conditions, with the combustion length set at 40 mm. The mainstream smoke from the exhaust port was collected in a gas bag (made of Tedlar) having He put therein in advance, and then the inner volume of the gas bag was adjusted with He to be 8 L in total. Fifty mL of the gas taken from the gas bag was analyzed by gas chromatography.

Attention was paid to pyrazines, phenols, hydrocarbons and ketones as specified components of the mainstream smoke, and data analysis of each of the specified components was performed based on the peak area on the gas chromatograph. Table 1 shows the penetration of each of the pyrazines and phenols. The penetration Ta of each of these specified components is represented by:

$$Ta=Aa/Acnt,$$

where Acnt denotes the peak area of the specified component on the gas chromatograph in the case where the adsorbent was not used (the control), and Aa denotes the peak area of the specified component on the gas chromatograph in the case of using the adsorbent "a". Each measured value shown in Table 1 was obtained on the basis of the peak area of the specified component on the gas chromatograph.

Also, the predicted value of the penetration for the filter using 60 mg of activated charcoal denotes the square of the measured value of the penetration for the filter using 30 mg of activated charcoal. The predicted value of the penetration for the filter using 60 mg of inorganic mineral-based porous material carrying ferrous sulfate/L-ascorbic acid (trade name: Anico W) denotes the square of the measured value of the penetration for the filter using 30 mg of inorganic mineral-based porous material carrying ferrous sulfate/L-ascorbic acid (trade name: Anico W). Similarly, the predicted value of the penetration for the filter using 60 mg of silica/alumina denotes the square of the measured value of the penetration for the filter using 30 mg of silica/alumina.

On the other hand, the predicted value of the penetration in the case of using the two types of the adsorbents shown in Table 1 denotes the calculated value of the penetration estimated from the penetration for the adsorbent in the case of using singly each of the two types of the adsorbents. To be more specific, the predicted value is represented by (Ta×Tb), where Ta denotes the penetration (measured value) of the specified component in the case of using the adsorbent "a", and Tb denotes the penetration (measured value) of the specified component in the case of using the adsorbent "b".

If the measured value of the penetration in the case of using a plurality of different types of adsorbents in combination is prominently smaller than the predicted value, it can be judged that the specified components are singularly adsorbed, which supports the synergetic effect produced by the combination of the plurality of types of the adsorbents. Table 1 shows the results of the above experiments.

TABLE 1

| | Penetration | | | |
|---|---|---|---|---|
| | Pyrazines | | Phenols | |
| Adsorbent | Measured value | Predicted value | Measured value | Predicted value |
| None | 1.00 | | 1.00 | |
| Activated charcoal (30 mg) | 0.60 | | 0.68 | |
| Ferrous sulfate/zeolite (30 mg) | 1.06 | | 0.86 | |
| Silica/alumina (30 mg) | 0.73 | | 0.61 | |
| Activated charcoal (60 mg) | 0.38 | 0.36 | 0.48 | 0.46 |
| Ferrous sulfate/zeolite (60 mg) | 1.02 | 1.12 | 0.73 | 0.74 |
| Silica/alumina (60 mg) | 0.54 | 0.53 | 0.38 | 0.37 |
| Mixture of activated charcoal (30 mg) and ferrous sulfate/zeolite (30 mg) (total 60 mg) | 0.32 | 0.63 | 0.38 | 0.58 |
| Mixture of activated charcoal (30 mg), ferrous sulfate/zeolite (15 mg) and silica/alumina (15 mg) (total 60 mg) | 0.35 | 0.53 | 0.43 | 0.49 |
| Cut tobacco side: Activated charcoal Mouth side: Ferrous sulfate/zeolite | 0.29 | 0.63 | 0.39 | 0.58 |
| Cut tobacco side: Ferrous sulfate/zeolite Mouth side: Activated charcoal | 0.32 | 0.63 | 0.360 | 0.58 |

Where the activated charcoal alone was used twice as much, where an inorganic mineral-based porous material carrying ferrous sulfate/L-ascorbic acid (trade name: Anico W) alone was used twice as much, or where silica/alumina was used twice as much, a significant difference was not recognized between the measured value and the predicted value.

A difference between the measured value and the predicted value was small in respect of hydrocarbons and ketones (not shown in Table 1), and thus, a synergetic effect produced by combination of plural types of adsorbents was not recognized.

To the contrary, where the combination of the activated charcoal and the inorganic mineral-based porous material carrying ferrous sulfate/L-ascorbic acid was used as the adsorbents, the measured values were markedly smaller than the predicted values in respect of pyrazines and phenols as shown in Table 1, which clearly supports that a synergetic effect on the singular adsorption of these specified components was produced.

Also, it was found that similar effect could be obtained in the cases where the activated charcoal and the inorganic mineral-based porous material carrying ferrous sulfate/L-ascorbic acid were mixed with each other (FIG. 1) and where the activated charcoal and the inorganic mineral-based porous material carrying ferrous sulfate/L-ascorbic acid were arranged separately (FIG. 2).

From the results given above, if the specified components of pyrazines and phenols are to be effectively adsorbed by using the activated charcoal alone, the inorganic mineral-based porous material carrying ferrous sulfate/L-ascorbic acid alone, or the silica/alumina alone, it is necessary to further increase the amount of the adsorbent. In this case, it is expected that the flavor and taste of the cigarettes are markedly affected. On the other hand, in the case of using in combination the activated charcoal and the inorganic mineral-based porous material carrying ferrous sulfate/L-ascorbic acid (and further the silica/alumina, if desired) as the adsorbents, it is expected that the specified components of pyrazines and phenols may be adsorbed effectively even if the amount of the adsorbents is small, and thus, the flavor and taste of the cigarette are less affected.

Figure 3:
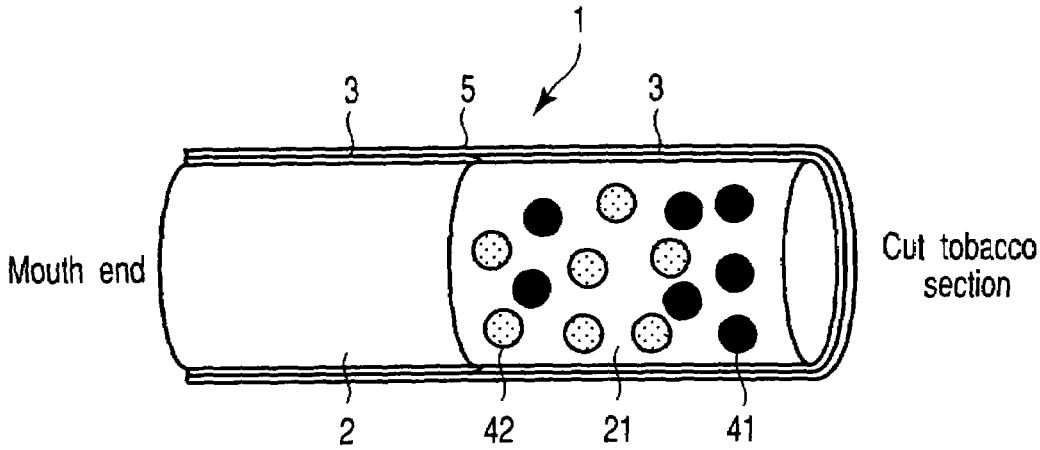
FIG. 3 schematically shows another example of a structure of a cigarette filter according to the present invention.

FIG. 3 shows still another example of a cigarette filter according to the present invention. The cigarette filter 1 was prepared as follows: preparing a filter material (plain filter) 2 obtained by forming acetate and another filter material 21 obtained by forming acetate having adsorbents of activated charcoal 41 and an inorganic mineral-based porous material carrying ferrous sulfate/L-ascorbic acid 42 dispersed therein; forming two filter sections by wrapping plug wrap paper 3 around each of the filter materials 2 and 21; and wrapping forming paper 5 around the two filter sections.

Figure 4:
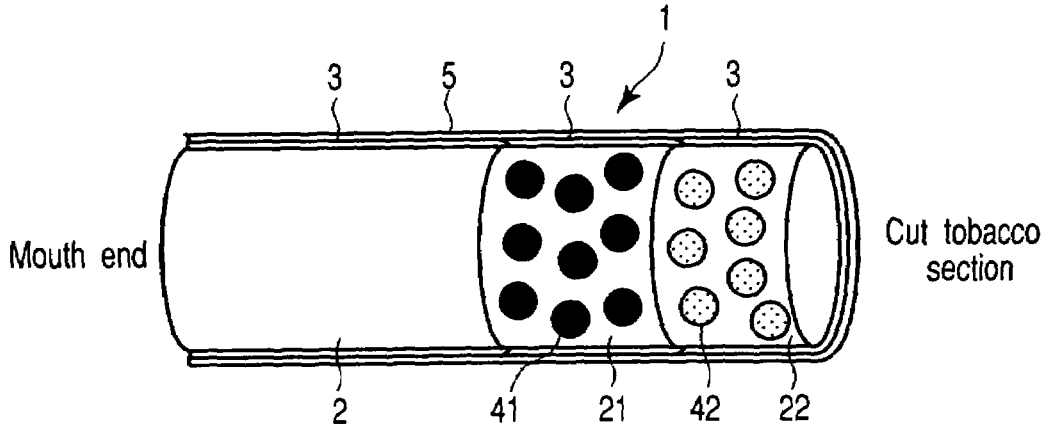
FIG. 4 schematically shows a further example of a structure of a cigarette filter according to the present invention.

FIG. 4 shows still another example of a cigarette filter according to the present invention. The cigarette filter 1 was prepared as follows: preparing a filter material (plain filter) 2 obtained by forming acetate, a filter material (charcoal filter) 21 obtained by forming acetate having activated charcoal 41 as an adsorbent dispersed therein, and a filter material 22 obtained by forming acetate having an inorganic mineral-based porous material carrying ferrous sulfate/L-ascorbic acid 42 as an adsorbent dispersed therein; forming three filter sections by wrapping plug wrap paper 3 around each of the filter materials 2, 21 and 22; and wrapping forming paper 5 around the three filter sections. The arrangement of the filter materials 21 and 22 is not particularly limited. It is possible to arrange any of these filter materials on the cut tobacco side.

Further, in the cigarette filter according to the present invention, it is possible to add activated charcoal and an inorganic mineral-based porous material carrying ferrous sulfate/L-ascorbic acid as adsorbents to the forming paper.

Figure 5:
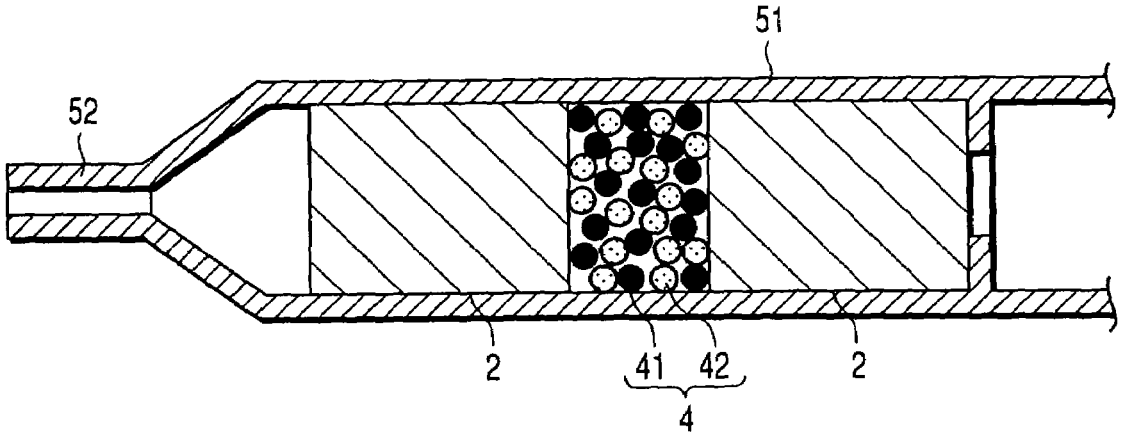
FIG. 5 is a cross-sectional view of a cigarette holder to which the cigarette filter according to the present invention is applied.

The cigarette filter according to the present invention can be applied in the form of a cigarette holder as shown in FIG. 5. The cigarette holder comprises a cylindrical cigarette holder body 51 having a mouth-end section 52 formed at one end, two filter materials 2 arranged inside the cigarette holder body 51, and a mixture of activated charcoal 41 and silica/alumina 42 as adsorbents 4 loaded in the space between the two filter materials 2.

The cigarette filter shown in FIG. 5 is obtained by applying the structure shown in FIG. 1 to a cigarette holder. Likewise, it is possible to apply the structure shown in each of FIGS. 2 to 4 to a cigarette holder.

In the cigarette filter of any of the types described above, a synergetic effect is produced by the activated charcoal and the inorganic mineral-based porous material carrying ferrous sulfate/L-ascorbic acid so as to singularly adsorb pyrazines and phenols.

According to the present invention, it is possible to provide a cigarette filter, which permits selectively removing specified components contained in mainstream smoke while suppressing the effect on the flavor and taste of the cigarette to a minimum.

What is claimed is:

1. A cigarette filter, comprising:

filter sections including filter materials individually wrapped with plug wrap paper;

forming paper for wrapping the filter sections integrally; and tipping paper covering the forming paper so as to connect the filter sections to a cigarette section to form a cigarette, wherein activated charcoal and an inorganic mineral-based porous material carrying ferrous sulfate/L-ascorbic acid are contained as adsorbents in at least one of the filter materials and a space between the filter materials, and wherein three filter materials are provided, and the activated charcoal is dispersed in one filter material and the inorganic mineral-based porous material carrying ferrous sulfate/L-ascorbic acid is dispersed in another filter material.

2. The cigarette filter according to claim 1, wherein silica/alumina is also contained as an adsorbent in addition to the activated charcoal and the inorganic mineral-based porous material carrying ferrous sulfate/L-ascorbic acid.

* * * * *